US005984845A

United States Patent [19]

Powers

[11] Patent Number: 5,984,845

[45] Date of Patent: Nov. 16, 1999

[54] BODY STRETCHING APPARATUS

[75] Inventor: Scott Powers, Tulsa, Okla.

[73] Assignee: Stretch Rite, Inc., Tulsa, Okla.

[21] Appl. No.: 09/225,960

[22] Filed: Jan. 6, 1999

[51] Int. Cl.[6] ..... A63B 23/10

[52] U.S. Cl. ..... 482/148; 482/125

[58] Field of Search ..... 482/148, 125

[56] References Cited

U.S. PATENT DOCUMENTS

| | | | |
|---|---|---|---|
| 324,498 | 8/1885 | Surbaugh . | |
| 3,119,614 | 1/1964 | Berry | 272/79 |
| 3,369,809 | 2/1968 | Morrill, Jr. | 272/79 |
| 3,843,119 | 10/1974 | Davis | 272/79 |
| 3,925,901 | 12/1975 | McCormick | 33/137 |
| 4,177,542 | 12/1979 | Denney | 24/115 |
| 4,456,247 | 6/1984 | Ehrenfried | 272/126 |
| 4,588,186 | 5/1986 | Calabrese | 272/126 |
| 4,819,936 | 4/1989 | Muller | 272/126 |
| 5,004,228 | 4/1991 | Powers | 272/125 |
| 5,277,680 | 1/1994 | Johnston | 482/95 |

*Primary Examiner*—Richard J. Apley
*Assistant Examiner*—Lori L Baker-Smith
*Attorney, Agent, or Firm*—Head, Johnson & Kachigian

[57] ABSTRACT

A body stretching apparatus includes two handgrip placement straps which are connected to a foot support device. Handgrips are installed onto the handgrip placement strap which are held in place by clips. Adjustable clips allow the handgrip placement straps to be adjusted to proper length. In operation, an operator sits on the floor in a "pike" position, grasping the hand grips in stages to stretch the legs and lower back. The individual handgrips are color-coded or otherwise marked with indicia to indicate different levels of stretching ability. The handgrips are conically shaped to make it easier for the operator to grip. In one embodiment, a back support and back strap helps to position the operator's upper body to prevent injury to the operator's lower back. In another embodiment, adjustable slides on the back strap shorten a distance between clasps on the ends of said back strap.

17 Claims, 4 Drawing Sheets

BODY STRETCHING APPARATUS

BACKGROUND OF THE INVENTION

1. Field of the Invention

The present invention relates generally to exercise equipment and relates specifically to a body stretching apparatus.

2. Prior Art

Fitness enthusiasts, runners, gymnasts, athletes, and low back pain sufferers are encouraged to stretch to increase flexibility and reduce injuries. The hamstring muscles and muscles in the lower back area are especially important to keep flexible because these muscle groups tend to tighten as we get older and can cause lower back pain and other injuries. People who have suffered a back injury or stroke, find stretching exercises therapeutic in rehabilitating the back injury or in treating neurologically-induced muscle tightness.

One of the most common ways to stretch these muscle groups is by sitting on the floor, with legs straight in front, reaching toward the toes, in a "pike" position. This maneuver is difficult and uncomfortable for most people. The ideal stretch requires stretching slowly and gradually, holding each stretch for 10–30 seconds. This allows muscle fibers to stretch to their maximum. Many people overstretch the muscles by bouncing. This can cause tears in the muscle fibers and ligaments, causing very painful injuries. It has been documented in exercise physiology that "static" stretching (slow, gradual, in stages) is much more effective than "ballistic" (bouncing) stretching. Improper stretching technique may be particularly hazardous to persons rehabilitating a back injury.

In the past, various types of leg stretching apparatus have been used. However, many apply to martial arts training and ballet in which flexibility is enhanced by stretching in the "split" position, which primarily stretches the inner thigh muscles.

U.S. Pat. No. 4,277,062 to Mark Lawrence discloses a leg stretching apparatus utilizing a cable-pulley system in which the legs are stretched into a "split" position, stretching the inner thigh muscles.

U.S. Pat. No. 4,456,247 to Ted Ehrenfried relates to an apparatus that utilizes a hand cranking device that also stretches the legs into a "split" position.

While the Lawrence and Ehrenfried devices are good for martial arts training or ballet, the present invention is practical for any age group whether athletic or non-athletic.

U.S. Pat. No. 5,004,228 ('228 patent) to Scott Powers discloses a leg stretching apparatus having two handgrip placement straps which are connected to a foot support member.

The device disclosed by the '228 patent is subject to a number of improvements. First, the device does not have an immediately apparent indicator of a user's flexibility level. Second, although the handgrips the '228 patent discloses are adequate for most purposes, the handgrips are not ideally shaped for users with gripping limitations, such as stroke and arthritis patients, accident victims, and children. A third problem is that persons with back injuries may aggravate the injury by positioning their pelvis or back in an inappropriate position in performing a stretching exercise. This type of injury aggravation may occur when the operator of the leg stretching apparatus fails to keep his lower back "in" instead of "out." When the lower back is positioned "out," the back is rounded and the operator stretches in the lower back. Ideally, the stretching should be done in the area of the hamstring muscles.

Another known method for stretching is the "towel" stretch. The towel is wrapped around the feet and the operator grasps the ends of the towel to stretch similar to the present invention. However, there are several disadvantages: there are no handgrips to hold, it is harder to stretch in even stages, and there are no means to measure the improvement in flexibility.

OBJECTS AND ADVANTAGES

Therefore, in view of the above and other disadvantages of prior art leg stretching apparatuses, it is an object of the present invention to provide a body stretching apparatus that enables an individual to stretch the hamstring and lower back muscles in a safe, slow and comfortable manner.

It is a further object of the present invention to provide individual handgrips which are easy to hold while stretching.

It is a further object of the present invention to provide handgrips which indicate a level of stretching ability.

It is a further object of the present invention to provide the user a means to stretch in several stages which is the most efficient and safe way to stretch.

It is further an object of the present invention to provide an apparatus to stretch the upper body (arms and shoulders).

It is a further object of the present invention to provide a body stretching apparatus which assists a user to keep his or her lower back in an inwardly curved position when stretching, thereby concentrating the stretching in the hamstring and leg muscles.

Additionally, it is an object of the present invention to provide a practical, small, and inexpensive device which is easily transportable, but very effective in increasing flexibility of the hamstring and lower back muscles.

SUMMARY OF THE INVENTION

The present invention is directed to an improved body stretching apparatus. The feet of a user or operator are placed in a foot support device having a center portion, a left end and a right end. Each end is connected to a handgrip placement strap so that the operator will grasp the handgrips. The handgrips are held in place by an adjustable clip.

Each grip on a single handgrip placement strap is of a different color with corresponding handgrips on either side of the foot support device of the same color. The colors or other indicia indicate the level of stretching or the level of difficulty the user is achieving in the stretching exercise.

The handgrips have a conical shape which makes it easier for the operator to grasp.

In an alternate embodiment and further modification, a back strap is attached to ends of the handgrip placement straps. The back strap cradles the lower back, supports the spine and allows the muscles of the lower back to relax.

BRIEF DESCRIPTION OF THE DRAWINGS

Other objects and advantages may be seen from the following description when viewed in conjunction with the accompanying drawings wherein.

DETAILED DESCRIPTION OF PREFERRED EMBODIMENTS

Figure 1:
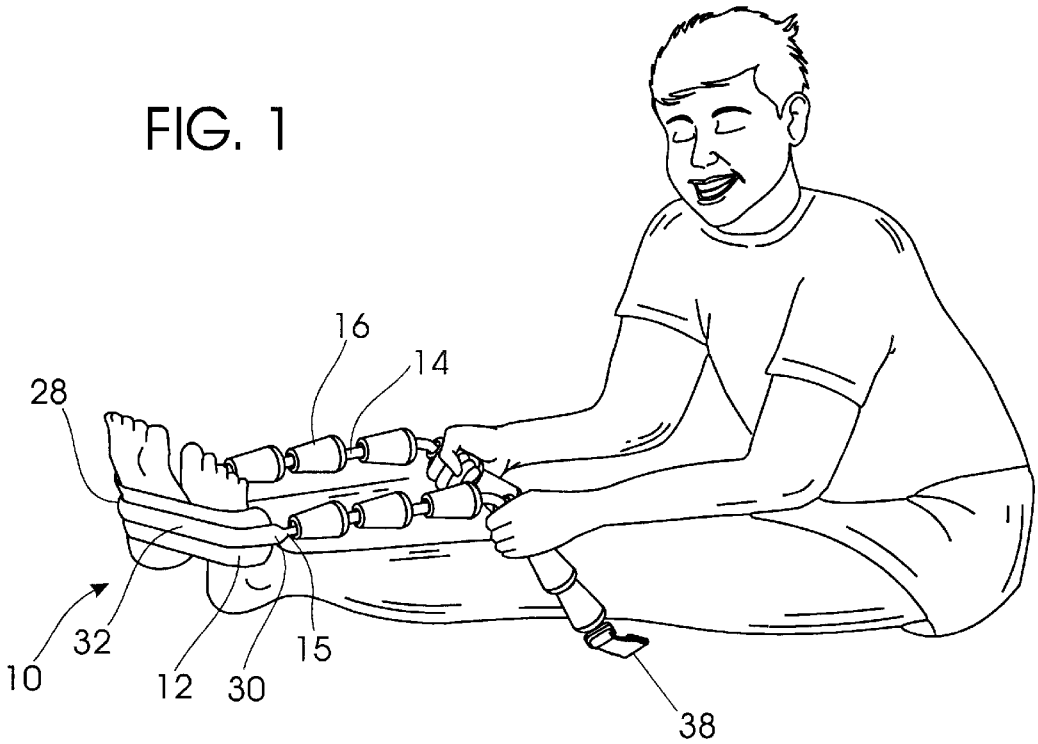
FIG. 1 is a perspective view of an operator using the body stretching apparatus of the present invention.

Referring now more particularly to the drawings, wherein like numerals represent like elements throughout several views, FIG. 1 generally shows an operator position and use of the body stretching apparatus 10. The operator is seated on the floor. The feet are placed in the foot support device 12, having a center portion 32, a left end 28, and a right end 30. The ends 28 and 30 are connected to the handgrip placement straps 14 and 15, respectively, in which the operator grasps the handgrips 16. The handgrips 16 are held in place by an adjustable clip 18, as will be seen more clearly in later figures.

Corresponding handgrips 16 on either side of the foot support device 12, are of the same color. Each handgrip 16 on a single handgrip placement strap 14 or 15 is of a different color. When the foot support device 12 is properly positioned around the operator's feet, the operator knows by the color of the two corresponding handgrips 16, which he holds in each hand, the level of stretching or level of difficulty he or she is achieving in the stretching exercise.

Figure 2:
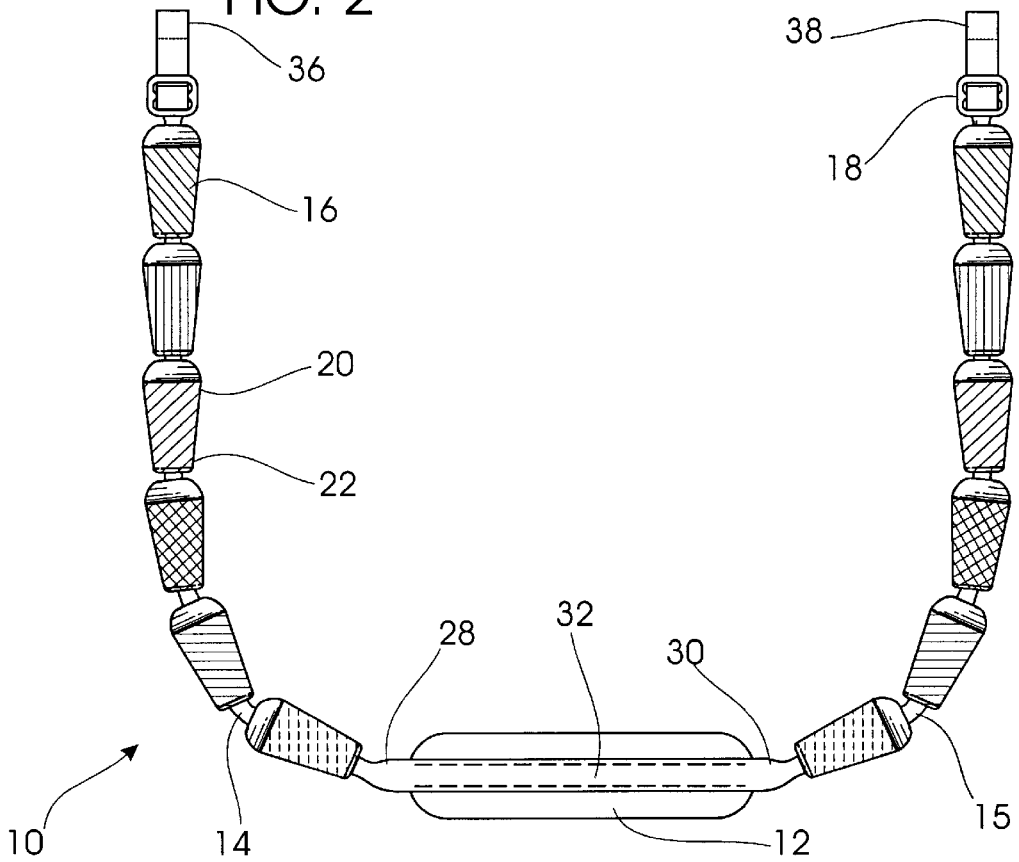
FIG. 2 is a front view, in a horizontal plan, of a body stretching apparatus of the present invention.

Referring now to FIG. 2 of the drawings, the foot support device 12, and the handgrip placement straps 14 and 15, are comprised of a preferred embodiment, in this instance, nylon webbing. The handgrips 16, are comprised of a preferred embodiment, in this instance, plastic, and are threaded onto the handgrip placement straps 14 and 15, through holes 24 drilled in the center. The handgrips 16 are held in place by an adjustable clip 18, which is comprised of a preferred embodiment, in this instance, plastic.

The different colored pairs of handgrips are seen clearly in FIG. 2. Alternatively, other indicia markings (not shown) might be used to indicate the level.

FIGS. 3 through 7 show the conical shape of the handgrips 16. Conical handgrips 16 are easier for the operator to grasp because, as the operator pulls on the handgrips in the direction shown in FIG. 3, he is pulling from a narrow top 22 to the broader base 20 of a frustrum of a cone. Thus, the conical handgrip 16 wedges tighter into the hand of the operator as the operator pulls on the handgrip 16.

Figure 3:
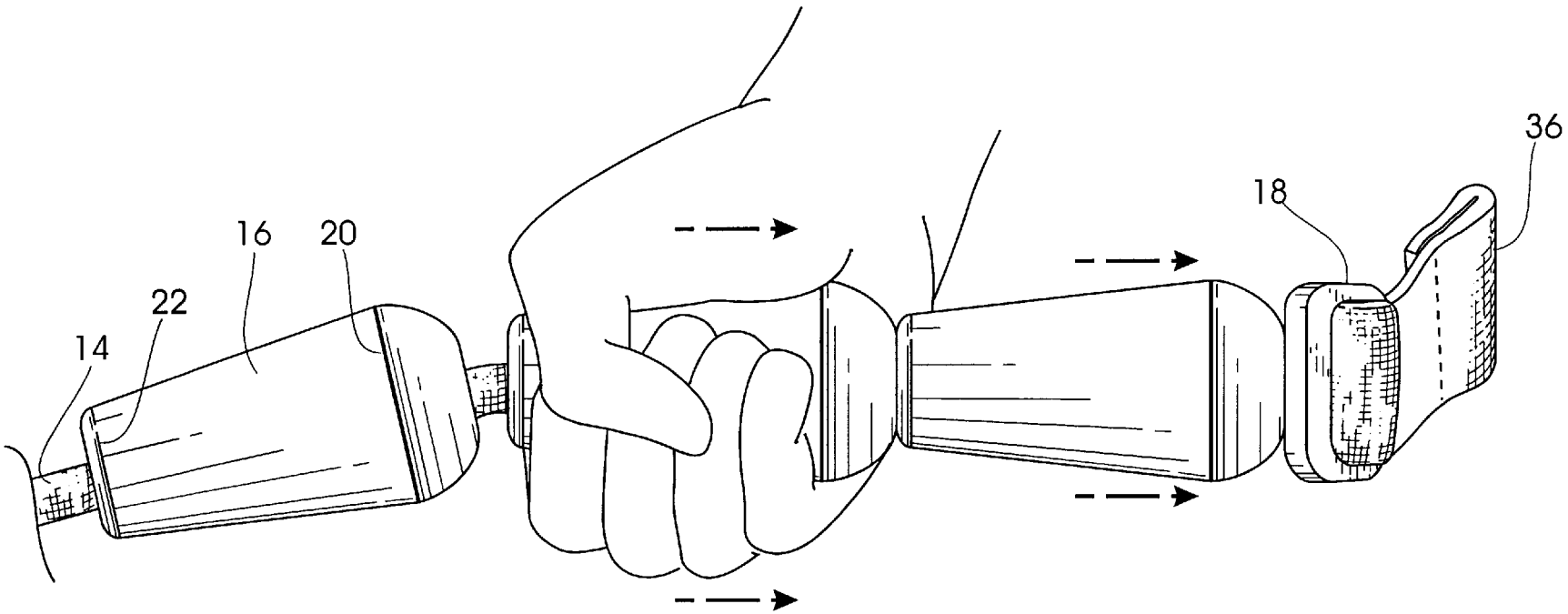
FIG. 3 is a fragmentary environmental view showing an individual using the body stretching apparatus.
Figure 4:
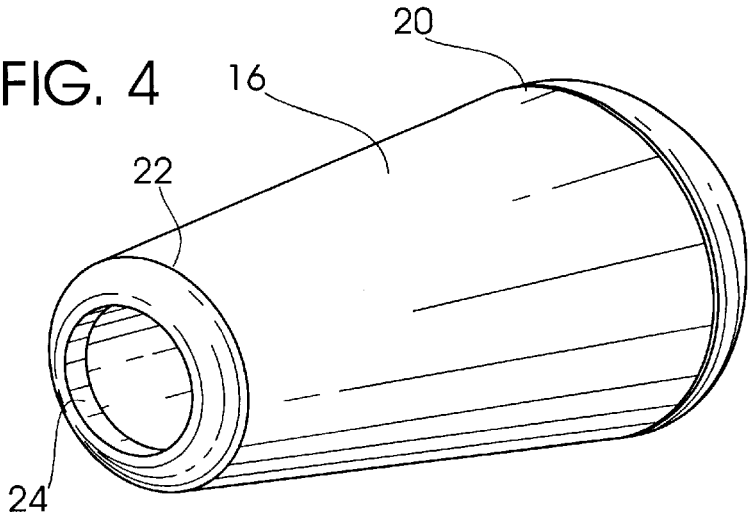
FIG. 4 shows a perspective view of a handgrip of the present invention.
Figure 5:
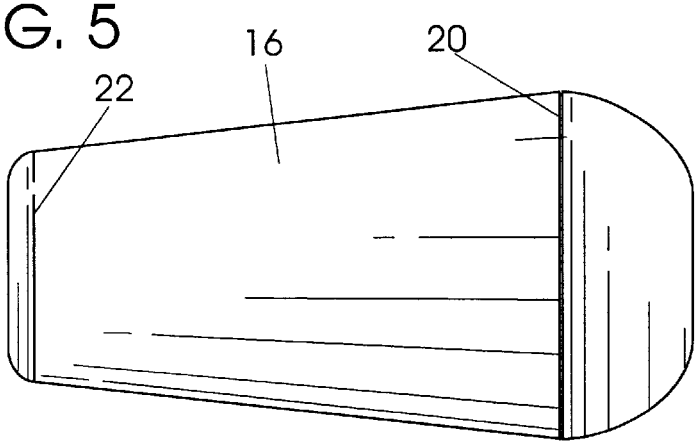
FIG. 5 shows a horizontal plan view of a handgrip of the present invention.
Figure 6:
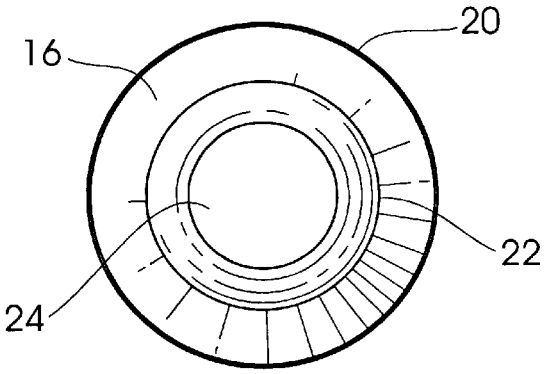
FIG. 6 shows a left end view of the handgrip shown in FIG. 5.
Figure 7:
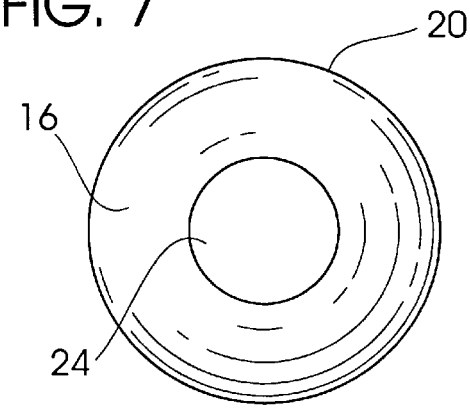
FIG. 7 shows a right end view of the handgrip shown in FIG. 5.

The handgrips 16 shown in FIG. 3 are color-coded. Each handgrip 16 on a handgrip placement strap 14 or 15 is of a different color. Corresponding handgrips 16 on each side of the foot support device 12 have the same color.

Figure 8:
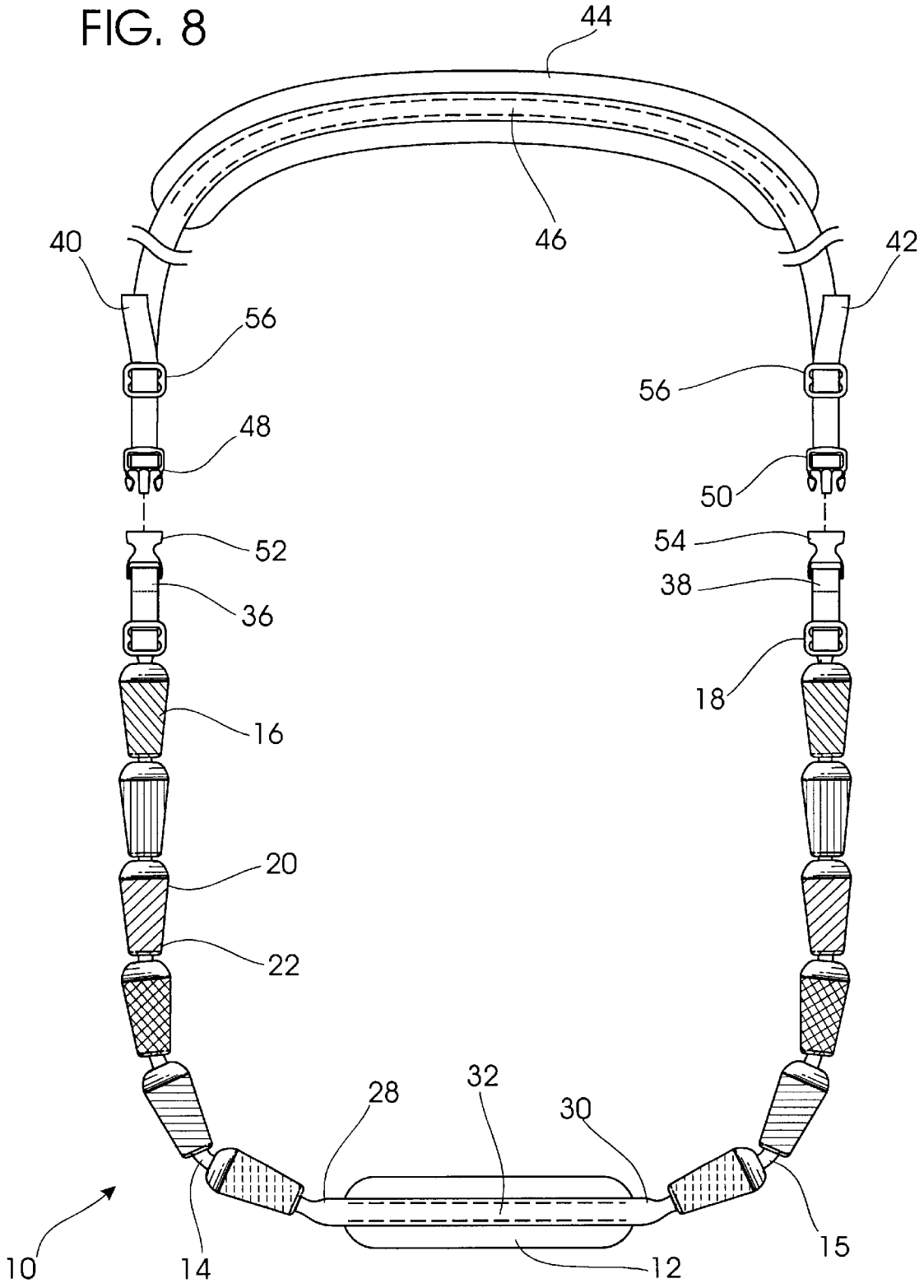
FIG. 8 is a front view, in a horizontal plan, of a body stretching apparatus with a back strap of the present invention.

In an alternative embodiment shown in FIG. 8, a back support strap 34 is attached to ends 36 and 38 of each handgrip placement strap 14 and 15. The back support strap 34 has ends 40 and 42 and a back support 44 at a back strap center portion 46. Male clasps 48 and 50 are threaded on the back support strap 34 near the ends 40 and 42. The handgrip strap ends 36 and 38 fit through female clasps 52 and 54 and are looped back to attach to the handgrip placement straps 14 and 15. The back support strap 34 cradles the lower back, which makes stretching more comfortable and efficient.

Many individuals have very tight hamstrings, which leads to "rounding" the back which is not the correct technique for stretching the hamstring area (rounding the back stretches the back instead of the hamstring area). The back support strap, as it is adjusted, changes the angle of the pelvis, pushing the lower back "in" instead of "out" which rounds the back. By cradling the lower back, the back strap 34 supports the spine and allows the muscles of the lower back to relax. When the back support strap 34 is properly positioned around the operator's back, it restrains the operator from moving his lower back to an outwardly-curved position, and helps to concentrate the stretching in the hamstring muscles. The back support strap 34 has two adjustment slides 56, each of which is movable to change a distance along the back support strap 34 between the male clasps 48 and 50, in order to facilitate use by operators of different size.

Depending on the ultimate user of such a device, many different materials could be used for the foot support device 12, and handgrip placement straps 14 and 15. Such materials would be constructed from nylon, foam, cotton, wood, plastics, metal, or other materials. Additionally, the adjustable clip 18 and the adjustable slide 56 could be constructed of many materials such as plastic, metal or wood. The handgrips 16 could be constructed of wood, plastic, ceramic or metal, with a foam or rubber exterior to further aid in grasping the handgrips 16. It is also clear that the geometry of the foot support device 12, handgrip placement straps 14 and 15, handgrips 16, and adjustable clip 18 could be changed substantially without departing from the spirit of the present invention. Additionally, the method for securing the handgrip placement straps 14 and 15 to the handgrips 16 could be changed depending on how much travel would be desired for a given displacement of the handgrips 16.

Whereas, the present invention has been described in relation to the drawings attached hereto, it should be understood that other and further modifications, apart from those shown or suggested herein, may be made within the spirit and scope of this invention.

What is claimed is:

1. A body stretching apparatus to allow a user to stretch hamstring and lower back muscles, comprising:

(a) a foot support device having a left end and a right end;

(b) a non-elastic, elongated handgrip placement strap with one portion of said handgrip placement strap emanating from said left end of said foot support device and another portion of said handgrip placement strap emanating from said right end of said foot support device;

(c) a plurality of like elements on each handgrip placement strap portion, each of said elements slidably receivable on each of said handgrip placement strap portion; and (d) each of said elements having different indicia representative of a users' level of flexibility on each portion of said handgrip placement strap.

2. The body stretching apparatus of claim 1 wherein said handgrip placement straps are of substantially the same length.

3. The body stretching apparatus of claim 2 wherein corresponding elements which are substantially equidistant from a center of said foot support device have the same color.

4. The body stretching apparatus of claim 3 wherein said elements on each of said handgrip placement strap have different colors.

5. A body stretching apparatus as set forth in claim 1 including a back support having a back strap which is connectable to said handgrip placement strap.

6. The body stretching apparatus of claim 1 wherein each portion of said handgrip placement strap terminates in an adjustable clip.

7. A body stretching apparatus to allow a user to stretch hamstring and lower back muscles, comprising:

(a) a foot support device having a left end and a right end;

(b) a non-elastic, elongated handgrip placement strap with one portion of said handgrip placement strap emanating from said left end of said foot support device and another portion of said handgrip placement strap emanating from said right end of said foot support device;

(c) elements, wherein said elements are handgrips, each said handgrip having a hole therethrough to slidably receive one of said handgrip placement straps, whereby said handgrips are retained on said handgrip placement straps by said clip and adjustment of said clip determines the position of said handgrips along each said handgrip placement strap;

(d) wherein corresponding handgrips on the pair of handgrip placement straps have the same color indicia; and (e) wherein each handgrip on a single handgrip placement strap has a different color indicia.

8. The body stretching apparatus of claim 7 wherein said handgrip placement straps are of substantially the same length.

9. The body stretching apparatus of claim 7 wherein there are six handgrips on each of said handgrip placement straps.

10. The body stretching apparatus of claim 7 wherein said handgrips are conical.

11. A body stretching apparatus to allow a user to stretch hamstring and lower back muscles, comprising:

(a) a foot support device having a left end and a right end;

(b) a non-elastic, elongated handgrip placement strap with one portion of said handgrip placement strap emanating from said left end of said foot support device and another portion of said handgrip placement strap emanating from said right end of said foot support device;

(c) handgrips, each said handgrip having a hole therethrough to slidably receive one of said handgrip placement straps, whereby said handgrips are retained on said handgrip placement straps by said clip and adjustment of said clip determines the position of said handgrips along each said handgrip placement strap;

(d) wherein corresponding handgrips on the pair of handgrip placement straps have the same color indicia; and (e) wherein each handgrip on a single handgrip placement strap has a different color indicia.

(f) a back support; and (g) a back strap with two ends which connect to ends of said handgrip placement strap by clasp means.

12. The body stretching apparatus of claim 11 wherein said clasp means comprises:

(a) a female clasp attached to said ends of said handgrip support strap;

(b) a male clasp attached to said ends of said back support strap; and (c) wherein said female clasp releasably engages said male clasp to fasten said back strap ends to said handgrip placement strap ends.

13. The body stretching apparatus of claim 12 further comprising an adjustable slide on said back strap, wherein moving said slide changes the distance between said male clasps.

14. The body stretching apparatus of claim 11 wherein said handgrip placement straps are of substantially the same length.

15. The body stretching apparatus of claim 14 wherein corresponding handgrips which are substantially equidistant from a center of said foot support device have the same color.

16. The body stretching apparatus of claim 15 wherein said handgrips on each of said handgrip placement strap have different colors.

17. The body stretching apparatus of claim 11 wherein there are two or more handgrips on each of said handgrip placement straps.

* * * * *